US010004285B2

(12) United States Patent
Johnson

(10) Patent No.: US 10,004,285 B2
(45) Date of Patent: Jun. 26, 2018

(54) KNEE PAD SYSTEM

(71) Applicant: Jonathan Johnson, Citrus Heights, CA (US)

(72) Inventor: Jonathan Johnson, Citrus Heights, CA (US)

( * ) Notice: Subject to any disclaimer, the term of this patent is extended or adjusted under 35 U.S.C. 154(b) by 117 days.

(21) Appl. No.: 15/048,421

(22) Filed: Feb. 19, 2016

(65) Prior Publication Data

US 2017/0238629 A1 Aug. 24, 2017

(51) Int. Cl.
*A41D 13/06* (2006.01)
*A41D 13/05* (2006.01)
*A41D 1/06* (2006.01)

(52) U.S. Cl.
CPC ..... *A41D 13/0556* (2013.01); *A41D 1/06* (2013.01); *A41D 13/065* (2013.01)

(58) Field of Classification Search
CPC ..... A41D 13/065; A41D 13/0556; A41D 13/0562
See application file for complete search history.

(56) References Cited

U.S. PATENT DOCUMENTS 759,765 A * 5/1904 Stall ..... A41D 13/065 2/228
1,792,048 A * 2/1931 Swenson ..... A41D 13/0568 2/24
1,857,850 A * 5/1932 Jones ..... A63B 71/1225 2/23
2,030,135 A * 2/1936 Carpenter ..... C09J 7/02 156/766
2,561,872 A * 7/1951 Krinick ..... A41D 13/065 2/24
2,568,083 A * 9/1951 Mitchell ..... A41D 13/0556 2/23
3,168,746 A * 2/1965 Smith ..... A41D 13/0575 2/23
3,346,877 A * 10/1967 Zirves ..... A41D 13/0568 2/24
4,024,584 A * 5/1977 Smith ..... A41D 13/065 2/22
4,097,932 A * 7/1978 Lacey ..... A41D 13/0568 2/24
4,488,314 A * 12/1984 Johnson ..... A41D 1/08 2/23
4,490,855 A * 1/1985 Figgie, III ..... A41D 13/0568 2/24
4,561,124 A * 12/1985 Thompson ..... A41D 1/067 2/227
4,593,416 A * 6/1986 Figgie, III ..... A41D 13/0568 2/24
4,613,991 A * 9/1986 Grover ..... A41D 1/067 2/227
4,685,153 A * 8/1987 Sims ..... A41D 13/065 2/24

(Continued)

*Primary Examiner* — Bobby Muromoto, Jr.

(57) ABSTRACT

A knee pad system includes a pair of pants that may be worn. The pants including a pair of legs and each of the legs has an inside surface. A pair of cushions is provided and each of the cushions is removably coupled to the pants. Each of the cushions is aligned with an associated one of a pair of a user's knees. Thus, each of the cushions may cushion the associated knee when the user kneels. Each of the cushions is positioned on the inside surface to conceal each of the cushions.

6 Claims, 6 Drawing Sheets

(56) References Cited

U.S. PATENT DOCUMENTS 4,831,666 A * 5/1989 Denman ..... A41D 13/065 2/23
4,893,355 A * 1/1990 Ritter ..... A41D 13/065 2/16
5,038,408 A * 8/1991 DeBaene ..... A41D 13/0537 2/227
5,105,473 A * 4/1992 Valtakari ..... A41D 13/015 2/22
5,551,084 A * 9/1996 Freese, III ..... A41D 13/0575 2/23
5,557,804 A * 9/1996 Ovortrup ..... A41D 13/0506 128/888
5,560,041 A * 10/1996 Walker ..... A41D 13/0568 2/24
5,732,412 A * 3/1998 Holden ..... A41D 13/065 2/23
6,014,771 A * 1/2000 Kirven ..... A41D 1/08 2/227
6,317,888 B1 * 11/2001 McFarlane ..... A41D 13/0568 2/24
6,347,403 B1 * 2/2002 Wilcox ..... A41D 13/0556 2/23
6,421,839 B1 * 7/2002 Vo ..... A41D 13/0575 2/227
6,704,938 B2 * 3/2004 Crockett ..... A41D 13/0568 2/23
6,745,406 B2 * 6/2004 Ruane ..... A41D 13/0506 2/23
6,751,804 B1 * 6/2004 Warner ..... A41D 1/067 2/23
D494,324 S * 8/2004 Mundy ..... D29/121.1
6,988,281 B1 * 1/2006 Jerome ..... A41D 13/065 2/24
7,062,789 B1 * 6/2006 Blackwell ..... A41D 1/08 2/79
7,089,596 B2 * 8/2006 Leflet ..... A41D 1/086 2/23
7,216,370 B1 * 5/2007 Warner ..... A41D 13/0575 2/23
7,219,372 B2 * 5/2007 Frieler ..... A41D 13/065 2/23
7,237,270 B2 * 7/2007 Crye ..... A41D 13/065 2/24
7,296,301 B1 * 11/2007 Conn ..... A41D 13/065 2/23
7,380,283 B1 * 6/2008 Dumont ..... A41D 13/0562 2/23
7,389,547 B1 * 6/2008 Wiens ..... A41D 1/08 2/227
7,490,360 B2 * 2/2009 Meadows ..... A41D 13/0556 2/23
7,945,968 B2 * 5/2011 Johnson ..... A41D 13/065 2/23
7,950,067 B2 * 5/2011 Williams, Jr. ..... A41D 13/0556 2/23
8,656,514 B2 * 2/2014 Neuron ..... A41D 1/06 2/227
9,021,614 B2 * 5/2015 Tepper ..... A41D 13/0153 2/22
9,167,856 B1 * 10/2015 Pacific ..... A41D 13/065
9,572,380 B2 * 2/2017 Sizemore ..... A41D 13/065
9,655,391 B2 * 5/2017 Carver ..... A41D 13/0568
2005/0060782 A1 * 3/2005 Sallas ..... A41D 11/00 2/23
2006/0005292 A1 * 1/2006 Crye ..... A41D 13/065 2/24
2006/0248625 A1 * 11/2006 Van Trojen ..... A41D 13/065 2/69
2006/0277644 A1 * 12/2006 Dobkin ..... A41D 13/015 2/24
2006/0282938 A1 * 12/2006 Jewell ..... A41D 13/0581 2/227
2007/0150993 A1 * 7/2007 Oh ..... A41D 13/0556 2/24
2007/0169250 A1 * 7/2007 Maniguet ..... A41D 1/08 2/227
2007/0282240 A1 * 12/2007 Hunter ..... A61F 5/0109 602/62
2008/0168589 A1 * 7/2008 Richards ..... A41D 13/065 2/24
2008/0222767 A1 * 9/2008 Williams ..... A41D 13/065 2/24
2008/0289072 A1 * 11/2008 Shin ..... A41D 13/0556 2/23
2009/0083901 A1 * 4/2009 Pardillo ..... A41D 13/065 2/455
2009/0113594 A1 * 5/2009 Tenorio ..... A41D 13/065 2/23
2009/0144873 A1 * 6/2009 Jewell ..... A41D 13/0581 2/24
2009/0293167 A1 * 12/2009 Kottler ..... A41D 1/08 2/23
2010/0024100 A1 * 2/2010 Sokolowski ..... A41D 1/002 2/455
2010/0235960 A1 * 9/2010 Johnson ..... A41D 13/065 2/23
2011/0219510 A1 * 9/2011 Nuzzo ..... A41D 13/0575 2/16
2012/0117705 A1 * 5/2012 Hawkins ..... A41F 9/00 2/23
2012/0131729 A1 * 5/2012 Hernandez ..... A41D 13/065 2/410
2012/0311755 A1 * 12/2012 Neuron ..... A41D 1/06 2/23
2013/0061365 A1 * 3/2013 Arceo ..... A41D 13/065 2/24
2014/0033412 A1 * 2/2014 Sizemore ..... A41D 13/065 2/455
2014/0215679 A1 * 8/2014 Habip ..... A41D 13/0506 2/23
2015/0149115 A1 * 5/2015 Belt ..... A41D 13/065 702/166
2016/0345642 A1 * 12/2016 Brothers ..... A41D 13/0575
2017/0065007 A1 * 3/2017 Picone ..... A41D 13/0556

* cited by examiner

KNEE PAD SYSTEM

BACKGROUND OF THE DISCLOSURE

Field of the Disclosure

The disclosure relates to knee pad devices and more particularly pertains to a new knee pad device for coupling knee pads to pant legs.

SUMMARY OF THE DISCLOSURE

An embodiment of the disclosure meets the needs presented above by generally comprising a pair of pants that may be worn. The pants including a pair of legs and each of the legs has an inside surface. A pair of cushions is provided and each of the cushions is removably coupled to the pants. Each of the cushions is aligned with an associated one of a pair of a user's knees. Thus, each of the cushions may cushion the associated knee when the user kneels. Each of the cushions is positioned on the inside surface to conceal each of the cushions.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
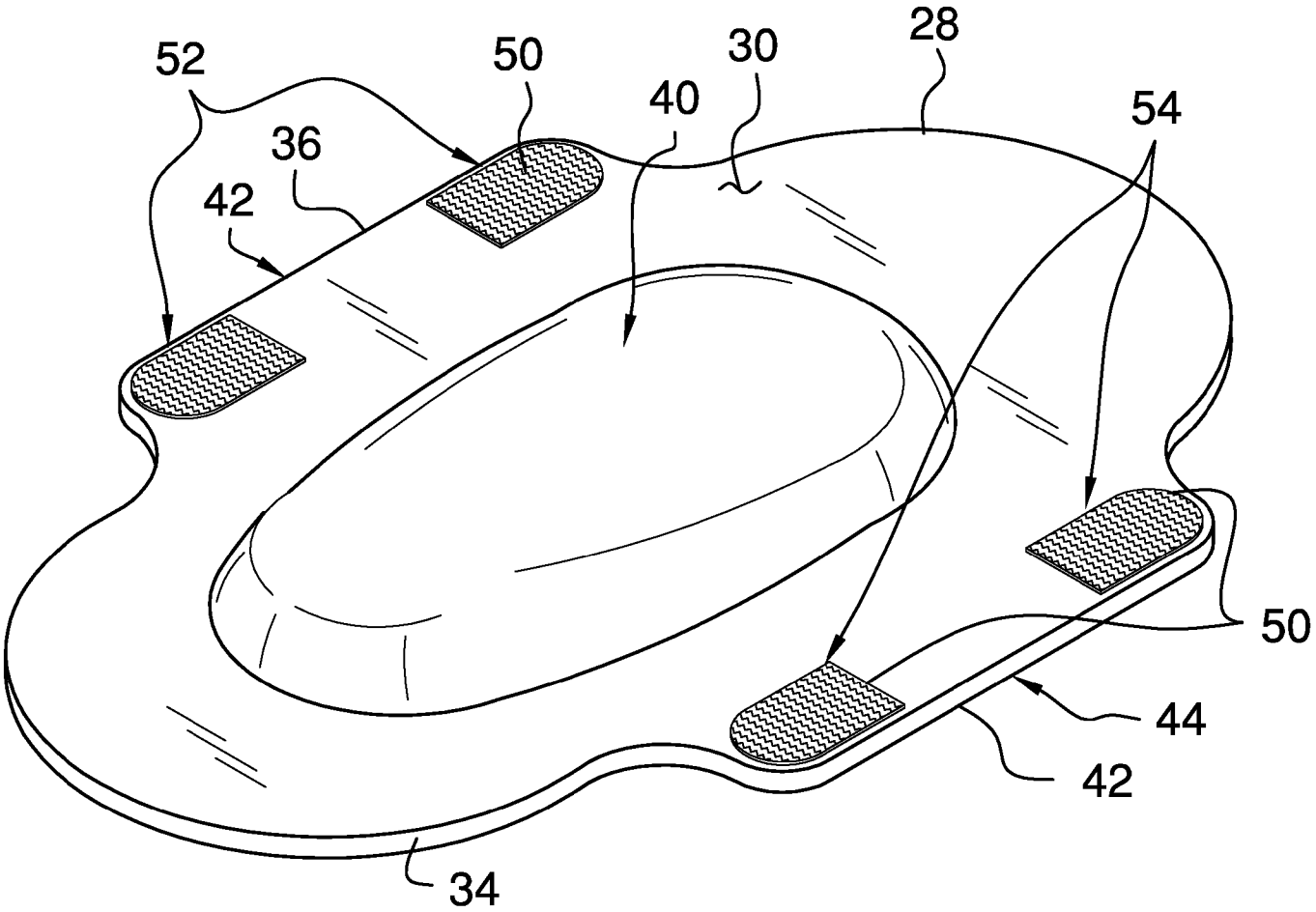
FIG. 1 is a front perspective view of a knee pad system according to an embodiment of the disclosure.
Figure 2:
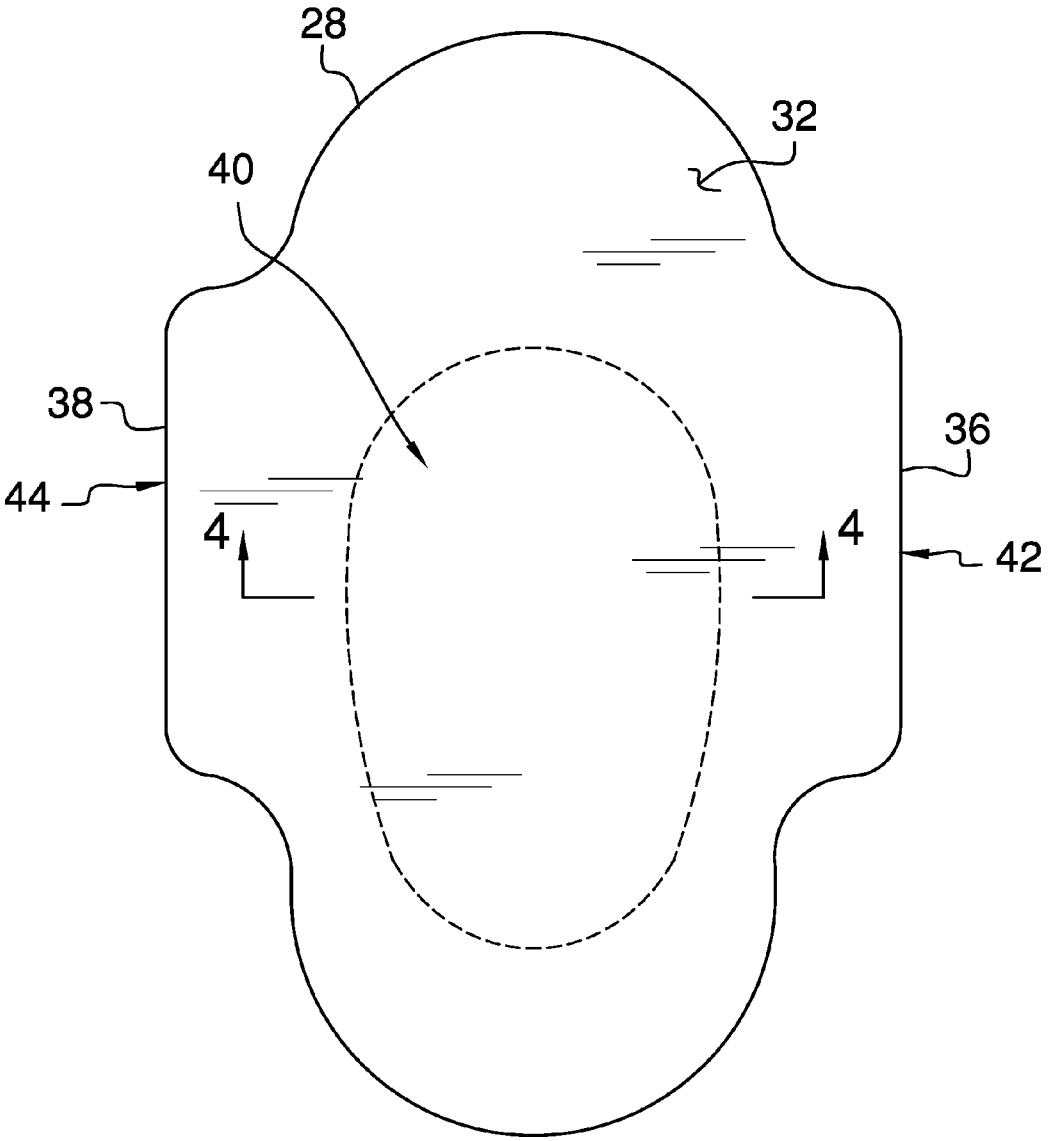
FIG. 2 is a back view of an embodiment of the disclosure.
Figure 3:
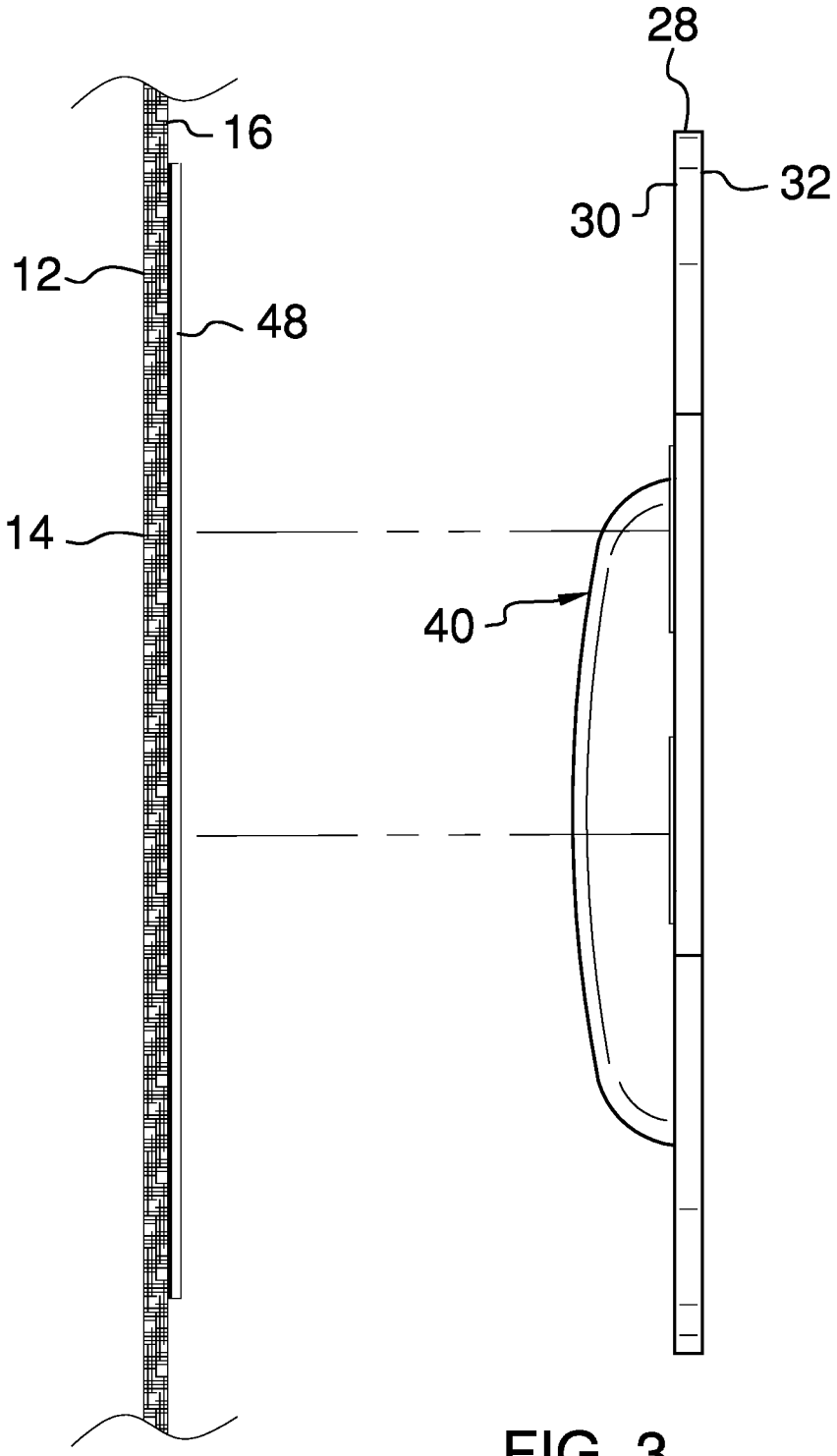
FIG. 3 is a left side perspective view of an embodiment of the disclosure.
Figure 4:
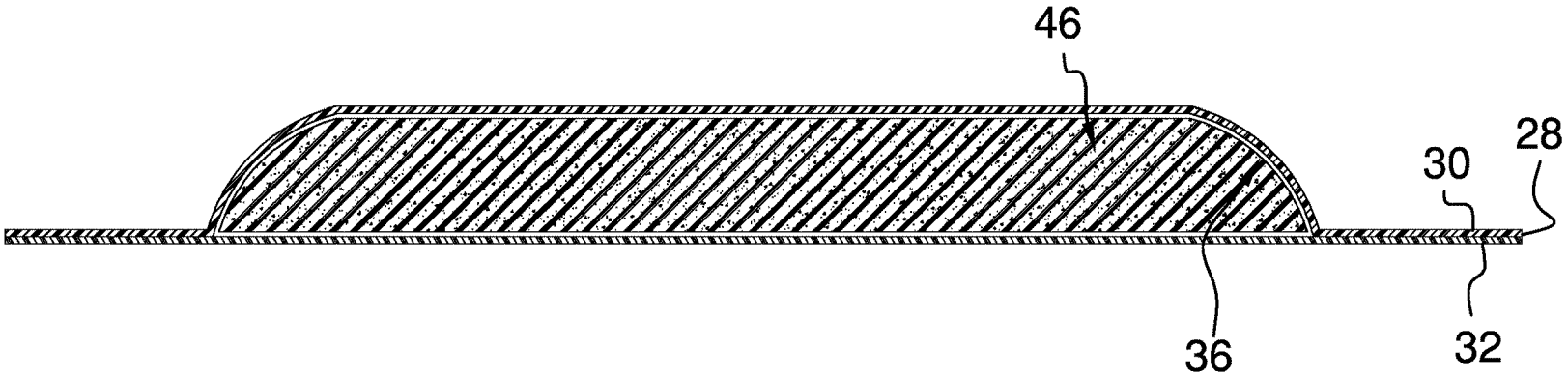
FIG. 4 is a cross sectional view taken along line 4-4 of FIG. 2 of an embodiment of the disclosure.
Figure 5:
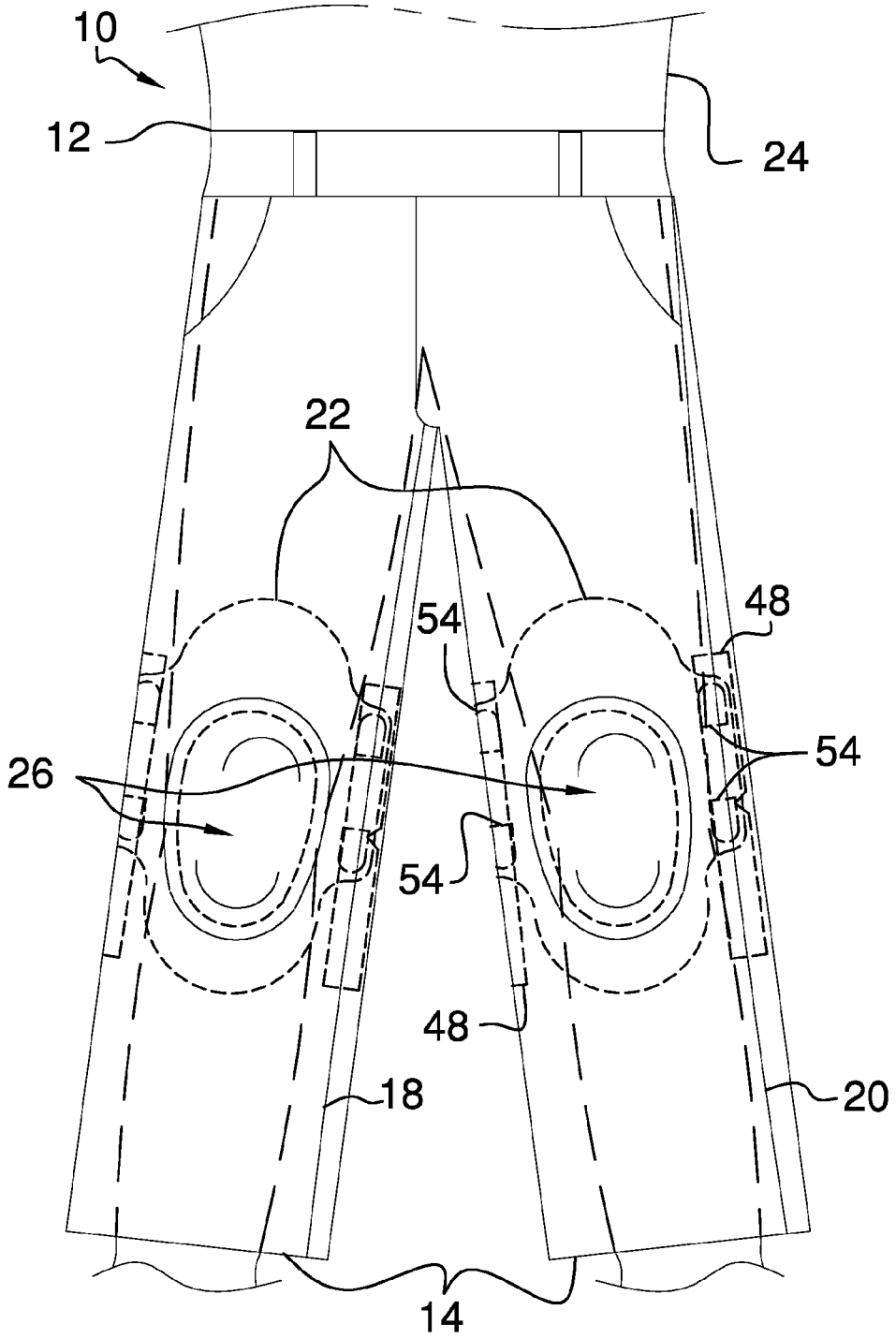
FIG. 5 is a phantom in-use view of an embodiment of the disclosure.
Figure 6:
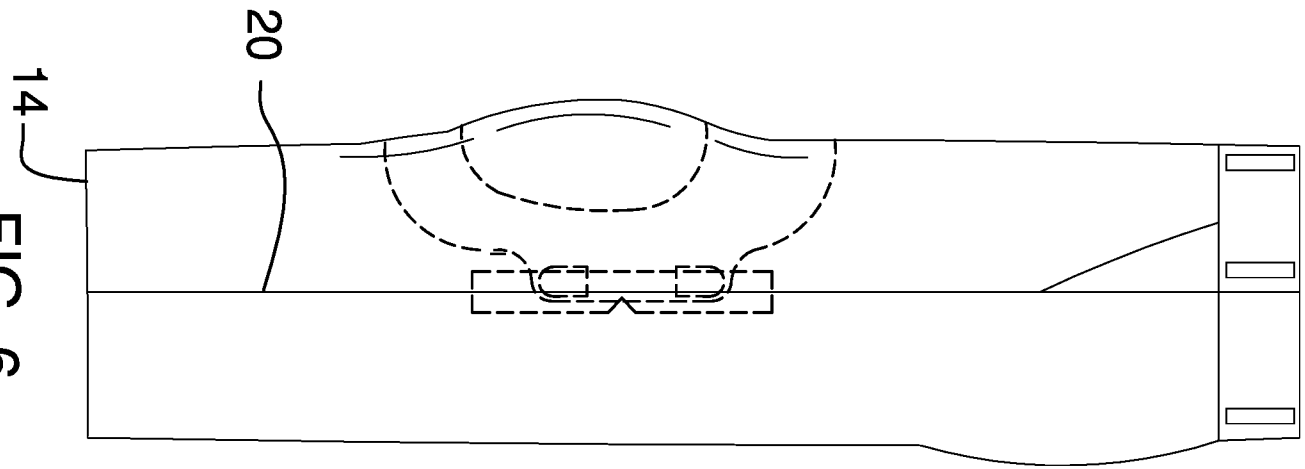
FIG. 6 is a perspective in-use view of an embodiment of the disclosure.

With reference now to the drawings, and in particular to FIGS. 1 through 6 thereof, a new knee pad device embodying the principles and concepts of an embodiment of the disclosure and generally designated by the reference numeral 10 will be described.

As best illustrated in FIGS. 1 through 6, the knee pad system 10 generally comprises a pair of pants 12 that may be worn. The pants 12 include a pair of legs 14. Each of the legs 14 has an inside surface 16, an inseam 18 and an outseam 20. The pants 12 may comprise pants of any conventional design.

A pair of cushions 22 is provided. Each of the cushions 22 is removably coupled to the pants 12. Each of the cushions 22 is aligned with an associated one of a pair of a user's 24 knees 26 when the user 24 wears the pants 12. Thus, each of the cushions 22 may cushion the associated knee 26 when the user 24 kneels. Each of the cushions 22 is positioned on the inside surface 16 thereby facilitating each of the cushions 22 to be concealed.

Each of the cushions 22 comprises a first pad 28 that has a first surface 30, a second surface 32 and a peripheral edge 34 extending between the first surface 30 and the second surface 32. The peripheral edge 34 is continuous and the first pad 28 has an ovoid shape. The peripheral edge 34 has a first lateral side 36 and a second lateral side 38. The first pad 28 is elongated along the first lateral side 36 and the second lateral side 38.

The first pad 28 has a cupped section 40 and the cupped section 40 is concavely arcuate with respect to the second surface 32. Thus, the cupped section 40 surrounds the associated knee 26 when the pants 12 are worn. The cupped section 40 is centrally positioned on the first pad 28. The first lateral side 36 extends outwardly from the cupped section 40 to define a first tab 42 of the first pad 28. The second lateral side 38 extends outwardly from the cupped section 40 to define a second tab 44 of the first pad 28. The first pad 28 is comprised of a deformable material such as thermoplastic elastomer or the like.

A second pad 46 is coupled to the first pad 28. The second pad 46 abuts the knee 26 when the user 24 bends thereby facilitating the second pad 46 to cushion the knee 26. The second pad 46 is coextensive with the second surface 32 corresponding to the cupped section 40. The second pad 46 is comprised of a resiliently compressible material such as polyurethane or the like.

A pair of first couplers 48 is provided and each of the first couplers 48 is coupled to the pair of pants 12. The first couplers 48 are positioned on the inside surface 16. One of the first couplers 48 is aligned with the inseam 18. One of the first couplers 48 is aligned with the outseam 20.

A plurality of second couplers 50 is provided. Each of the second couplers 50 is coupled to the first pad 28. Each of the second couplers 50 is positioned on the first surface 30. The second couplers 50 are complementary with respect to the first couplers 48. Thus, the first pad 28 is removably retained on the pants 12 thereby facilitating the first pad 28 to be resiliently aligned with the associated knee 26.

The second couplers 50 include a first set of second couplers 52 that are spaced apart from each other and distributed along the first tab 42. Each of the first set of second couplers 52 engages the first coupler 48 corresponding to the inseam 18. The second couplers 50 include a second set of second couplers 54 that are spaced apart from each other and distributed along the second tab 44. Each of the second set of second couplers 50 engages the first coupler 48 corresponding to the outseam 20. Each of the first couplers 48 and the second couplers 50 may comprise a hook and loop fastener or the like.

In use, each of the cushions 22 is positioned in the associated leg 14 of the pants 12. The second couplers 50 corresponding to each of the cushions are coupled to the associated first couplers 48. The pants 12 are worn. Each of the cushions 22 protects the user's knees 26 when the user 24 kneels. Each of the cushions 22 is substantially concealed with the user 24 stands thereby enhancing an appearance of the pants 12. Each of the cushions 22 is removed from the pants 12 when the pants 12 are laundered.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A knee pad system comprising:

a pair of pants, said pants being configured to be worn, said pants including a pair of legs, each of said legs having an inside surface, an inseam and an outseam; and a pair of cushions, each of said cushions being removably coupled to said pants wherein each of said cushions is configured to be aligned with an associated one of a pair of a user's knees thereby facilitating each of said cushions to cushion the associated knee when the user kneels, each of said cushions being positioned on said inside surface wherein each of said cushions is configured to be concealed, each of said cushions including a first pad having a first surface, a second surface and a peripheral edge extending between said first surface and said second surface, said peripheral edge being continuous such that said first pad has an ovoid shape, said peripheral edge having a first lateral side and a second lateral side, said first pad having a cupped section, said cupped section being concavely arcuate with respect to said second surface wherein said cupped section is configured to surround the associated knee, said cupped section being centrally positioned on said first pad, said first lateral side extending outwardly from said cupped section to define a first tab of said first pad positioned along a middle of said first lateral side, said first tab having a straight outer edge oriented parallel to a central longitudinal axis of said first pad, said second lateral side extending outwardly from said cupped section to define a second tab of said first pad positioned along a middle of said second lateral side, said second tab having a straight outermost edge oriented parallel to said straight outer edge of said first tab, said first pad being comprised of a deformable material.

2. The system according to claim 1, further comprising a second pad being coupled to said first pad wherein said second pad is configured to abut the knee when the user bends thereby facilitating said second pad to cushion the knee, said second pad being coextensive with said second surface corresponding to said cupped section, said second pad being comprised of a resiliently compressible material.

3. The system according to claim 1, further comprising a pair of first couplers, each of said first couplers being coupled to said pair of pants, said first couplers being positioned on said inside surface, one of said first couplers being aligned with said inseam, one of said first couplers being aligned with said outseam.

4. The system according to claim 1, further comprising:

a pair of first couplers; and a plurality of second couplers, each of said second couplers being coupled to said first pad, each of said second couplers being positioned on said first surface, said second couplers being complementary with respect to said first couplers such that said first pad is removably retained on the said pants thereby facilitating said first pad to be resiliently aligned with the associated knee.

5. The system according to claim 4, wherein second couplers comprise:

a first set of second couplers being spaced apart from each other and distributed along said first tab, each of said first set of second couplers engaging said first coupler corresponding to said inseam, and a second set of second couplers being spaced apart from each other and distributed along said second tab, each of said second set of second couplers engaging said first coupler corresponding to said outseam.

6. A knee pad system comprising:

a pair of pants, said pants being configured to be worn, said pants including a pair of legs, each of said legs having an inside surface, an inseam and an outseam; and a pair of cushions, each of said cushions being removably coupled to said pants wherein each of said cushions is configured to be aligned with an associated one of a pair of a user's knees thereby facilitating each of said cushions to cushion the associated knee when the user kneels, each of said cushions being positioned on said inside surface wherein each of said cushions is configured to be concealed, each of said cushions comprising:

a first pad having a first surface, a second surface and a peripheral edge extending between said first surface and said second surface, said peripheral edge being continuous such that said first pad has an ovoid shape, said peripheral edge having a first lateral side and a second lateral side, said first pad having a cupped section, said cupped section being concavely arcuate with respect to said second surface wherein said cupped section is configured to surround the associated knee, said cupped section being centrally positioned on said first pad, said first lateral side extending outwardly from said cupped section to define a first tab of said first pad positioned along a middle of said first lateral side, said first tab having a straight outer edge oriented parallel to a central longitudinal axis of said first pad, said second lateral side extending outwardly from said cupped section to define a second tab of said first pad positioned along a middle of said second lateral side, said second tab having a straight outermost edge oriented parallel to said straight outer edge of said first tab, said first pad being comprised of a deformable material, a second pad being coupled to said first pad wherein said second pad is configured to abut the knee when the user bends thereby facilitating said second pad to cushion the knee, said second pad being coextensive with said second surface corresponding to said cupped section, said second pad being comprised of a resiliently compressible material, a pair of first couplers, each of said first couplers being coupled to said pair of pants, said first couplers being positioned on said inside surface, one of said first couplers being aligned with said inseam, one of said first couplers being aligned with said outseam, a plurality of second couplers, each of said second couplers being coupled to said first pad, each of said second couplers being positioned on said first surface, said second couplers being complementary with respect to said first couplers such that said first pad is removably retained on the said pants thereby facilitating said first pad to be resiliently aligned with the associated knee, second couplers comprising:

a first set of second couplers being spaced apart from each other and distributed along said first tab, each of said first set of second couplers engaging said first coupler corresponding to said inseam, and a second set of second couplers being spaced apart from each other and distributed along said second tab, each of said second set of second couplers engaging said first coupler corresponding to said outseam.

* * * * *